United States Patent [19]

Albrecht et al.

[11] 4,405,387

[45] Sep. 20, 1983

[54] PROCESS TO PRODUCE A REVERSIBLE TWO-WAY SHAPE MEMORY EFFECT IN A COMPONENT MADE FROM A MATERIAL SHOWING A ONE-WAY SHAPE MEMORY EFFECT

[75] Inventors: Joachim Albrecht, Mülligen; Thomas Duerig, Nussbaumen; Walter Weber, Zürich, all of Switzerland

[73] Assignee: BBC Brown, Boveri & Company Limited, Baden, Switzerland

[21] Appl. No.: 402,230

[22] Filed: Jul. 27, 1982

[30] Foreign Application Priority Data

Feb. 5, 1982 [CH] Switzerland ..... 704/82

[51] Int. Cl.[3] ..... C21D 8/00

[52] U.S. Cl. ..... 148/11.5 R; 148/11.5 C; 148/402

[58] Field of Search ..... 148/11.5 C, 11.5 A, 148/11.5 R

[56] References Cited

U.S. PATENT DOCUMENTS

| | | | |
|---|---|---|---|
| 3,285,470 | 11/1966 | Frei et al. | 428/960 |
| 3,748,197 | 7/1973 | Willson et al. | 428/960 |
| 3,977,913 | 8/1976 | Cabo et al. | 428/960 |

FOREIGN PATENT DOCUMENTS

| | | | |
|---|---|---|---|
| 638622 | 12/1978 | U.S.S.R. | 428/960 |

*Primary Examiner*—L. Dewayne Rutledge
*Assistant Examiner*—Debbie Yee
*Attorney, Agent, or Firm*—Oblon, Fisher, Spivak, McClelland & Maier

[57] ABSTRACT

A notable two-way effect can be induced in components made of a memory alloy exhibiting only a one-way effect by applying an external force which gives rise to an internal stress opposing the one-way effect. Component made of a memory alloy in the form of a tension, compression bending, or torsion rod (helical spring 2). External force by weight or spring (counter-spring 3).

5 Claims, 1 Drawing Figure

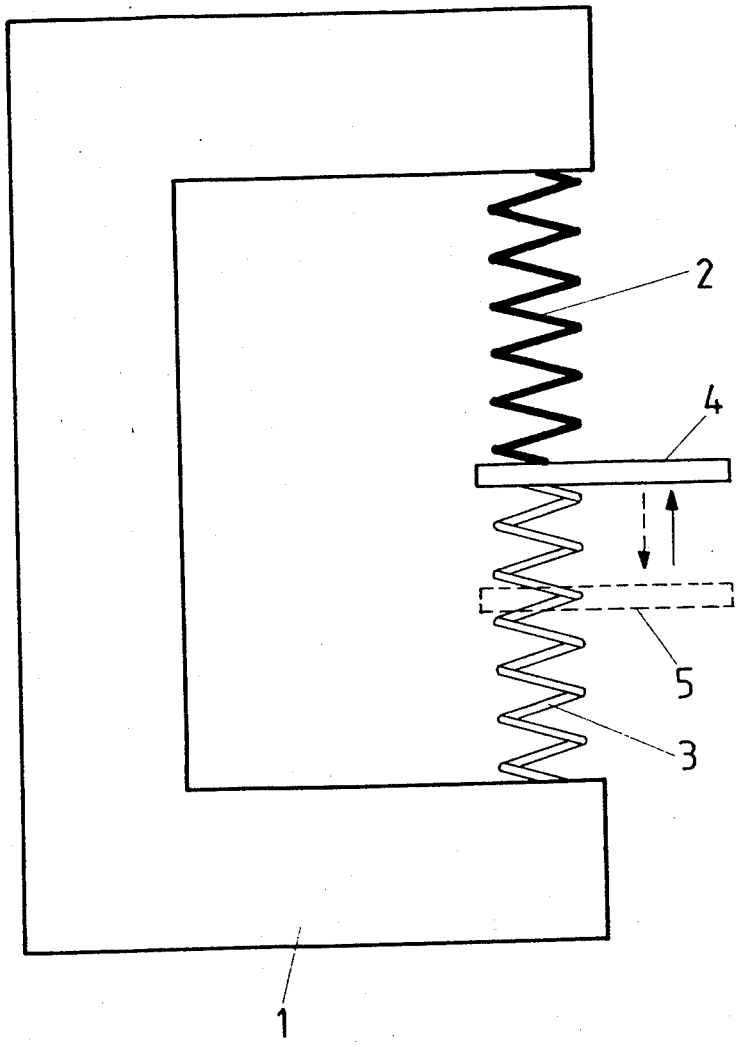
2
4
5
3
1

PROCESS TO PRODUCE A REVERSIBLE TWO-WAY SHAPE MEMORY EFFECT IN A COMPONENT MADE FROM A MATERIAL SHOWING A ONE-WAY SHAPE MEMORY EFFECT

This invention concerns a process to produce a two-way shape memory effect in components made of memory alloys exhibiting a one-way effect.

With memory alloys in general, the difference between the so-called two-way effect and the one-way effect must be distinguished. While the latter is generally more pronounced, better known (e.g.—Ni-Ti and the $\beta$-brasses) and has led to numerous applications, the two-way effect is more problematic and difficult to control. There is, however, a common technological demand for components which show a two-way effect of sufficient magnitude to open further interesting fields of application. Usually the temperature of the martensitic transformation in the classical two-way shape memory alloys falls into an undesirable temperature range. There are, however, a number of shape memory alloys, especially the the $\beta$-brasses such as the classical Cu-Al-Ni and Cu-Al alloys, which have a suitable transformation temperature; these alloys have a remarkable one-way effect, but a negligible two-way effect.

The following documents can be quoted as "state of the art":

R. Haynes, Some Observations on Isothermal Transformations of Eutectoid Aluminium Bronzes Below their $M_s$-Temperatures, Journal of the Institute of Metals 1954–1955, Vol. 83, pages 357–358; W. A. Rachinger, A "Super Elastic" Single Crystal Calibration Bar, British Journal of Applied Physics, Vol. 9, June 1958, pages 250–252; R. P. Jewett, D. J. Mack, Further Investigation of Cu-Al Alloys in the Temperature Range Below the $\beta$ to $\alpha+\gamma_2$ Eutectoid, Journal of the Institue of Metals, 1963–1964, Vol. 92, pages 59–61; K. Otsuka and K. Shimizu, Memory Effect and Thermoelastic Martensite Transformation in Cu-Al-Ni Alloy, Scripta Metallurgica, Vol. 4, 1970, pages 469–472; K Otsuka, Origin of Memory Effect in Cu-Al-Ni Alloy, Japanese Journal of Applied Physics, Vol. 10, no. 5, May 1971, pages 571–579.

There is, therefore, a demand for components made from shape memory alloys of the $\beta$-brass type, which have a transformation temperature suitable for certain specific applications, while exhibiting a noticeable two-way effect.

The purpose of this invention is to provide a process to produce components from an alloy which normally exhibits only a one-way effect, and to induce in these components, a considerable reversible two-way effect (at least under operating conditions).

This goal is achieved by the features indicated in claim 1.

The invention will be described in the following working examples, and illustrated in the attached diagram.

The FIGURE shows:

A component according to the described process, as exemplified by a combination of springs.

Illustrated are a helical spring made from an alloy showing only a one-way shape memory effect (2) and a normal spring (3) mounted between the two parallel arms of a frame (1). The springs, 2 and 3, are joined by a lever (4), the purpose of which is to transfer the movement of the springs to a load transfer mechanism, a release mechanism, or an indicating instrument. The springs, 2 and 3, and the lever, 4, are shown in their ground state positions; that is, the completely relaxed condition. The lever moves to position 5 upon heating, and returns to position 4 upon subsequent cooling. This is indicated by appropriate arrows.

Working Example I

As a starting material, a commercially available forged-titanium alloy of the following composition was used:

V: 10. wt. %
Fe: 2. wt. %
Al: 3. wt. %
Ti: balance

A suitable workpiece in the form of a rod was solution treated in the $\beta$-phase field, at a temperature of 850° C. for 15 minutes, and subsequently water quenched. From this workpiece, a cylindrical test rod of 7 mm diameter and 25 mm gauge length was machined. This specimen was stressed in tension parallel to its longitudinal axis to a strain of 3.0%. The load required to achieve this strain was then reduced to a tensional stress of 200 MPa applied to the cross-section of the rod. The test rod was heated to 250° C. in this condition, during which a contraction of 0.7% was observed in the longitudinal direction (corresponding to the one-way shape memory effect). After subsequently cooling to room temperature, an expansion of 0.3% in the longitudinal direction was measured (corresponding to a two-way shape memory effect). Further cycling between room temperature and 250° C. showed a complete reproducibility of the effects, proving that a reversible two-way shape memory effect was present.

For purposes of comparison, a rod of the same dimensions and heat treatment was subjected to an identical temperature cycle, but without the superimposed static load. In this case, no two-way shape memory effect was observed. This demonstrates that in a material exhibiting only a one-way shape memory effect (after an appropriate thermo-mechanical treatment), a noticeable two-way shape memory effect can be induced by superpositioning an additional static load.

Working Example II

The starting material was a shape memory alloy of the $\beta$-brass type, and was produced by powder metallurgical methods. The composition of the alloy was as follows:

Al: 14.2 wt. %
Ni: 3.2 wt. %
Cu: balance

The alloy was first hot rolled to a band of 2.5 mm thickness. Elements with a square cross-section of 2.5 mm by 2.5 mm and 35.0 mm length were machined from the hot rolled band, then solution treated for 15 minutes at 950° C. and water quenched. The elements were bent to produce an outer fiber strain of 5.0%. One of the elements was then mounted in a test rig so that the deflection could be measured; the deflection was measured between 20° C. and 250° C. while simultaneously applying various loads (in both the positive and negative directions). It was thus found that essentially no two-way shape memory effect exists without a load. However, if a load either hindering or supporting the free movement of the element was applied, a noticeable two-way shape memory effect was measured. This effect reached a maximum at an outer fiber stress of 200 MPa, working against the movement of the element. The maximum obtainable deflection corresponded to a reversible outer fiber strain (two-way shape memory effect) of approximately 1.8%. When the load was further increased, the two-way effect was found to decrease.

Working Example III

Test elements of the same composition and dimensions as in Example II were solution treated and quenched in the same manner, and then deformed 5% in bending. Additionally, they were subjected to a Shape Stabilization Treatment at 300° C. for 30 minutes under a static load, and to a Martensite Stabilization Treatment at 300° C. for 30 minutes without load. The subsequent test (as described in Example II) showed a noticeable two-way shape memory effect of approximately 1.5% (strain), even without an applied load. This effect could be increased to 2.0% by applying a stress of 100 MPa against the movement of the element. By applying the same load in the opposite direction, the two-way effect was reduced to 0.8%.

Working Example IV

See FIGURE.

A wire of 1.0 mm diameter was produced by conventional methods from the material described in Example II, and then coiled into a helical spring of 14.0 mm diameter. This spring was solution treated at 950° C. for 10 minutes and quenched in water. The spring was then deformed by a critical amount necessary to induce a shape memory effect. The memory spring (2) was mounted in the frame (1) coaxially with respect to spring 3 (without a prestress). The lever (4) was used to join the two springs, simultaneously providing a means to measure the movement or force. The individual parts (2, 3, and 4) are shown in their starting position. Upon heating to 200° C., spring 2 expanded, thus compressing spring 3, which thereby applied a variable counterforce to spring 2. The position of the lever in this condition is indicated by 5, and the direction of movement is indicated by a dashed arrow. Upon cooling, spring 2 contracted, returning the lever to its starting position according to 4; the direction of movement is, in this case, indicated by a solid arrow. This cycle could be repeated at will, indicating the presence of a reversible shape memory effect in the whole of the composite component.

The above examples are but a few of the possible applications of the invention. A composite component showing a reversible two-way shape memory effect can be realized, in principle, by using any element made of a shape memory alloy which shows only a one-way effect under normal circumstances; that is, during a free, unhindered movement. Under operating conditions, however, the element must be subjected to a force which, in turn gives rise to an inner stress opposing the one-way effect. This can be obtained by supplying an external load in the form of a counterweight, a spring, etc. The memory element can be in the form of a tension, compression, bending, or torsion rod (also in the form of a helical spring). The externally applied load can be either constant or variable, depending on the purpose of the application of the component.

The following alloy systems are particularly suitable for the above applications: Cu-Al-Ni, Cu-Al, Cu-Zn-Al, Ti-V, Ti-Nb, Ni-Ti, and Ni-Ti-Cu alloys.

The process described in the invention allows one to induce, during service, a notable two-way effect in a component normally exhibiting only a one-way effect or a two-way effect of insignificant magnitude. This opens further applications of practical importance for the above alloys in the field of relays, switches, and thermal actuators.

We claim:

1. A process for inducing a reversible two-way shape memory effect in an already existing component made of a shape memory alloy exhibiting a one-way effect comprising first solution treating said component in a temperature range of $\beta$-solid solution, subsequently quenching in water, and then deforming said component under operating conditions by subjecting to an external load said load being applied in the form of a counterweight, a spring, or an additional component rigidly joined to and hindering free movement of said shape memory component provoking an internal stress counteracting said one-way effect.

2. The process according to claim 1, wherein the said memory alloy is a Cu-Al-Ni, Cu-Al, Cu-Zn-Al, Ti-V or Ti-Nb, alloy.

3. The process according to claim 1, wherein the component is a tension rod stressed axially by a load in the form of a counterweight.

4. The process according to claim 1, wherein the component is a bending element stressed perpendicularly to the longitudinal axis by a static load in the form of a weight or a spring.

5. The process according to claim 1, wherein the component is a helical spring stressed equiaxially, but in opposition to the one-way effect by a counter-spring impressing a variable load.

* * * * *